US006641136B2

(12) United States Patent
Huang

(10) Patent No.: US 6,641,136 B2
(45) **Date of Patent: *Nov. 4, 2003**

(54) SPORTS PINBALL AMUSEMENT DEVICE

(75) Inventor: Sming Huang, Monmouth, NJ (US)

(73) Assignee: American Alpha INC, Monmouth Junction, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,538

(22) Filed: Jun. 14, 2001

(65) Prior Publication Data

US 2001/0030392 A1 Oct. 18, 2001

Related U.S. Application Data

(63) Continuation-in-part of application No. 09/801,457, filed on Mar. 8, 2001, now Pat. No. 6,390,470.

(51) Int. Cl.[7] ..... A63F 7/02

(52) U.S. Cl. ..... 273/121 R; 273/121 A; 273/119 R; 273/119 A; 273/118 R; 273/118 A

(58) Field of Search ..... 273/118 R, 118 A, 273/119 R, 119 A, 121 R, 121 A, 121.13, 123 R, 123 A, 127 R, 108

(56) References Cited

U.S. PATENT DOCUMENTS

| | | | | | |
|---|---|---|---|---|---|
| 4,015,847 | A | * | 4/1977 | Myers | 273/108.1 |
| 4,105,207 | A | * | 8/1978 | Cooper et al. | 273/121 B |
| 5,016,879 | A | * | 5/1991 | Parker et al. | 273/118 A |
| 5,121,919 | A | * | 6/1992 | Martti | 273/119 A |
| 5,137,278 | A | * | 8/1992 | Schilling et al. | 273/121 B |
| 5,149,093 | A | * | 9/1992 | Schilling et al. | 273/121 B |
| 5,342,049 | A | * | 8/1994 | Wichinsky et al. | 273/120 A |
| 5,904,352 | A | * | 5/1999 | Takemoto | 273/118 A |
| 6,029,973 | A | * | 2/2000 | Takemoto | 273/118 A |
| 6,203,009 | B1 | * | 3/2001 | Sines et al. | 273/118 A |
| 6,279,904 | B1 | * | 8/2001 | Huang | 273/108.32 |
| 6,390,470 | B1 | * | 5/2002 | Huang | 273/118 A |

* cited by examiner

*Primary Examiner*—Raleigh W. Chiu
(74) *Attorney, Agent, or Firm*—John Lezdey

(57) ABSTRACT

A sports game pinball amusement device for playing a sports game. The playing field contains a plurality slots with sensors for determining the activity in a game and a multiplicity of slots with sensors representing the final. The game is played by launching a ball along an inclined playing field to determine the plays in a baseball, football, soccer game or the like, which is programmed into a microprocessor.

13 Claims, 5 Drawing Sheets

SPORTS PINBALL AMUSEMENT DEVICE

RELATED APPLICATIONS

This application is a continuation-in-part of application Ser. No. 09/801,457 filed Mar. 8, 2001, now U.S. Pat. No. 6,390,470.

FIELD OF THE INVENTION

The present invention relates to a sports game pinball amusement device, which simulates a sports event using images of players displayed on a graphic display device. More particularly, there is provided a pinball machine, which simulates actions in a baseball, softball, football game, or the like.

BACKGROUND OF THE INVENTION

A large number of players play pinball games to kill time. However, because the pinball machine is a simple game and the game is over in a short period of time, there is a problem that the players are not able to kill time, as they desire. Further, because of the simple game, a large number of players lose interest in games.

Pinball machines have numerous configurations that are well known in the art. It is conventional practice in a pinball machine apparatus to modify the structure on the game surface, the design and the score value of different targets in order to revive the incentive of practiced players without changing the principal of the game.

There are many commercially available pinball machines that incorporate various scoring indicators, lights, graphics and sound. These machines include mechanical three-dimensional figures that communicate visually and audibly with a player.

U.S. Pat. No. 5,112,049 to Borg, which is herein incorporated by reference, discloses a pinball machine wherein a section of the playing field is changed by rotating the section to expose different components.

U.S. Pat. No. 5,405,142 to Arad, which is herein incorporated by reference, discloses a pinball machine having provisions for translating a ball in play throughout a plurality of locations. There is also provided an audio system to provide a speaking effect in response to different play conditions.

SUMMARY OF THE INVENTION

According to the present invention, there is provided a sports-oriented pinball machine having a slanted playing field and a plurality of representative playing slots arranged on the playing field about the bottom of the playing field to determine the activities specific for the sport. Playing slots are provided with sensors for detecting a ball that enters the slot. A microprocessor is provided, which is activated when a ball enters a slot to record an activity and/or a score and display the activity which occurred. Means are provided on the playing field to translate a ball in play throughout a plurality of locations thereon.

Advantageously, video and audio means are provided in association with the microprocessor for providing speaking and/or sound or light effects in response to different play conditions.

In a baseball game the action of the ball on the playing field can determine hits, runs, errors, stolen bases and the like.

In a football game, first downs, field goals, touchdowns, and lost yardage can be determined by the released ball.

It is therefore an object of the invention to provide a pinball game apparatus in which a sports activity is depicted.

It is a further object of the invention to provide a sports game pinball game apparatus, which alters the playing field to challenge the skill of the user.

It is yet another object of the invention to provide visual and sound effects, which respond to the playing conditions of a sports activity.

It is still another object to provide a game in which the essence of a baseball game or the like is provided.

The present invention will become more fully understood from the detailed description given hereinbelow and the accompanying drawings, which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
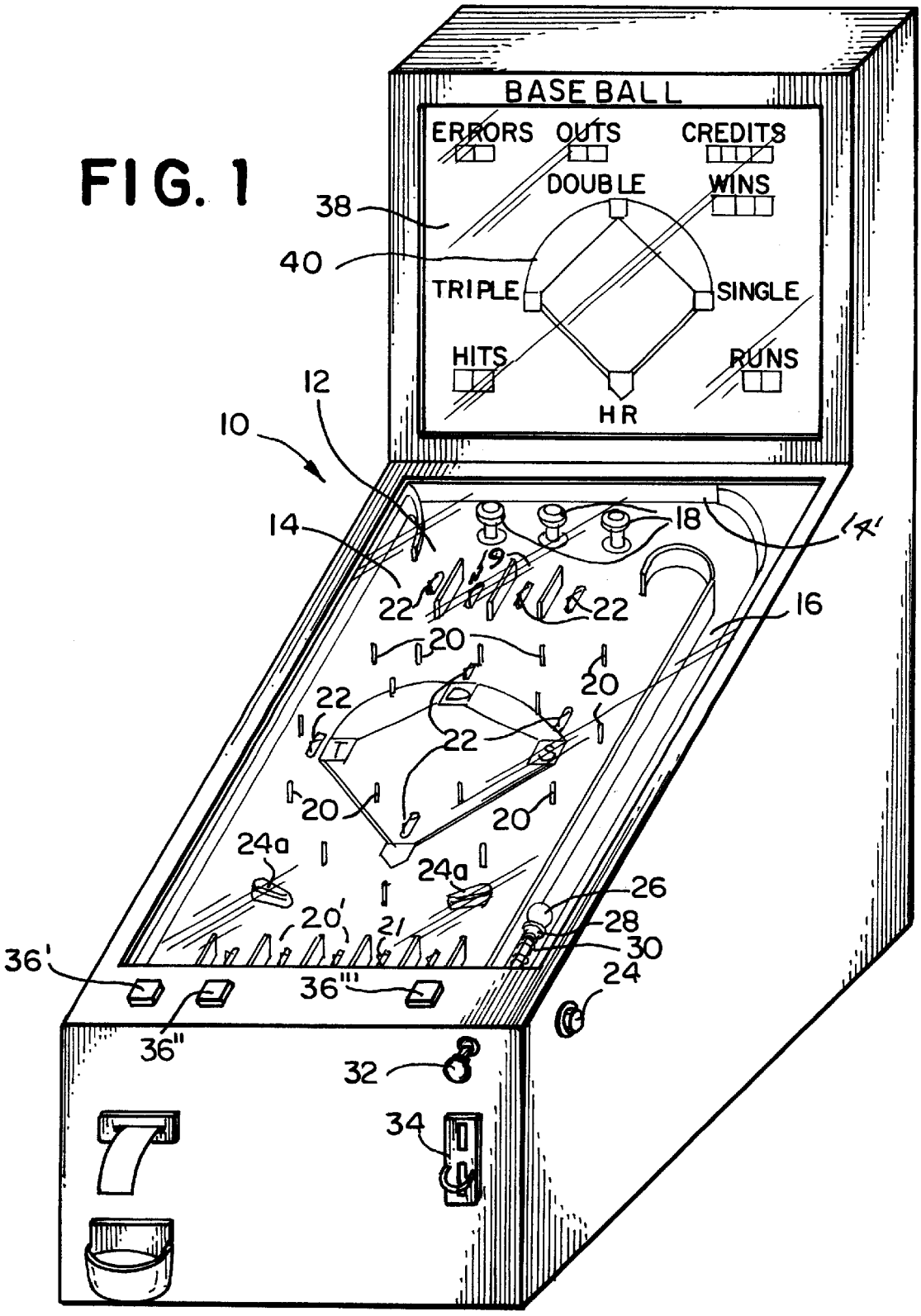
FIG. 1 is a perspective view of a sports pinball machine of the invention.

As seen in FIG. 1, in the simplest form of the invention, there is provided a pinball apparatus 10 comprising a housing having an upper face 12, which forms the sloping playing field. The playing field is conventionally covered by a transparent glass pane 14.

The housing is defined by a first or top wall $\mathbf{14}^1$, a rear wall 15 and side walls 16 and 17. The playing field 12 is inclined downwardly toward the rear wall 15 so that a ball will roll downwardly because of gravity.

The playing field has a plurality of path altering pins 20 and bumpers 18 to accommodate various ball path-altering provisions. The playing field may also contain first ball path altering slot or slots 19 formed by walls that contain sensors 22, which define the activities in the game. The pins 20 may also comprise various fixed and elastic, active and passive targets as common in the game.

Along the bottom wall 15 there is a plurality of slots $\mathbf{20}^1$, which contain sensors 21 that can sense a ball entering one of the slots $\mathbf{20}^1$. Slots $\mathbf{20}^1$ define the play in a particular game, for example, hit, home run, walk, etc.

Preferably, the slot or slots 19 define hits, strikes, balls and steals, and the bottom wall slots $\mathbf{20}^1$ define strike outs, walks, home runs, etc.

A ball launch guide 16, is disposed near one side of the housing. Launch guide 16 is bound by a wall which is offset a nominal distance from side wall 17 to form a ball launching channel. A spring loaded pull knob 32, ball contact end 28, and an intermediate body having a compression spring 30, is collinearly mounted through the housing along the longitudinal extent of launch guide 16. When knob 32 is fully extended, ball 26 exits launch guide 16, and is first expelled by releasing knob 32. Once ball 26 exits launch guide 16, it is in play and may come into contact with wall 14$^1$, bumpers 18, and enters first slots 19 which define a ball or strike. The object of the game is to enter into a selected slot 19 and 20$^1$. Each slot 20$^1$ is provided with a sensor 21, which is associated with a microprocessor that contains a program, which acts with a sensor 21 in the slots 20. In the case of baseball, the microprocessor provides either the actions of the home team or visitors. Two can play the game. The players skill in being able to enter a given slot 19 and 20 will decide the particular activity in the game desired.

Along the upper part of the housing and along the top wall 14$^1$ is a display board 32, which is associated with a microprocessor to provide the score and a visual display on screen 40 in accordance with the play on the playing field and the sensors 22 and 21 activated by a ball 26. The display can depict a player running, stealing a base, striking out, etc.

The microprocessor is also programmed to display images of players running, coin insertion, coin payout, etc. If the ball 26 enters a slot 20$^1$, the sensor signals the microprocessor, which senses the display board 32 and displays the activity and score. Generally, there are slots 20$^1$ on the playing field for each event in the game and optionally an additional slot for extra innings that is an LED so as to display that slot when scoring occurs of a particular value.

Along the playing field are a plurality of pins 20 and bumpers 18, which randomly direct the ball to slots 19 and 20$^1$. The size and shape of the pins as well as their positioning on the playing field have an effect on the ball and the odds of a ball going to a specific slot.

Upon inserting a number of coins into the slot 34 prior to playing the game, a sensing means senses the coins inserted so as to provide pulse signals corresponding to the number of coins which are transmitted to and counted by a detection unit and by pressing button 36$^{111}$, a signal is sent to activate the control unit which provides a signal to the microprocessor to activate the game.

The playing field may be provided with active and/or inactive pins and bumpers which not only provide scoring but also activate a video or sound program. The balls 26, as they roll down the inclined plane, randomly bump into pins or bumpers to deflect the path of the ball. At the bottom of the playing field, there may be provided thrust levers or flippers 24*a* controlled by buttons 24, which can direct the ball 26 into play for different slots or direction. The length of the flippers can be as conventionally used in a pinball apparatus.

The playing field at the back wall is provided with a gutter or return mechanism, which is conventional in the art. One such mechanism is described in U.S. Pat. No. 5,464,213, which is herein incorporated by reference.

The game is played in a manner similar to known pinball machines. In the preferred embodiment, the general rules are as follows: The player will play balls until three outs are recorded in the microprocessor. Scoring is made by having a ball enter into one of slots 19, which can depict a hit and then into one of slots 20$^1$ to obtain a score. The game can be started by placing coins into slot 34, whereby coin insert and detection unit signals the CPU. Alternatively, a start button 36$^{111}$ is pressed. The CPU has a control unit, which illuminates the game board by LED's, an LCD for visual display and the audio units.

The player selects the desired play by pressing one of the buttons 36$^1$, 36$^{11}$ after activities are displayed for the home team or visitor. The start button 36$^{111}$ causes the release of a ball 26 into launch channel 16.

The ball 26 is put into play by extending and releasing knob 32. The ball in play can be controlled by the skill of the player in being able to control the direction of the ball by a controlled vibration of the machine. Optionally, a tilt mechanism may be provided to control the degree of vibration. If the tilt detector is activated, the game is over.

The ball 26 travels downward toward the back wall 14$^1$ so as to enter one of the first set of slots 19 and activate one of the sensors 22 which are lit. According to the game, the direction of the ball is determined by the skill of the player in using the flippers 24*a* controlled by button 24 and in vibrating the apparatus.

The projected images and sounds can be triggered by one or more targets or pins 18 which are electrically connected with the CPU to trigger an image or sound upon impact with a ball 26. There may be provided a projector (not shown) which comprises a cassette with an endless film which cyclically produces an image on the display. There is further the possibility to trigger image reproduction and sound or change when the sensors 21, 22 have been activated.

The game of baseball can be played by releasing a ball to first go into one of the slots 19 to decide an action such as steal, hit by pitched ball, etc. The slots 19 may have actions for offense or defense or be randomly selected by the microprocessor whereby all slots display an offensive action or defensive action.

The slots will be displayed by LED or LCD after the game starts. The kind or value of the slots can be permanent or randomly selected. For baseball, the computer will select the outcome of each ball. The player could then shoot the ball to determine an offensive play or defensive play.

A similar arrangement can be made for the game of softball.

Along the playing field, near pins 20, may be positioned sensors 22 about the bases which indicate a single, double, or triple which has been hit so that action on the field can take place before the ball 26 reaches slots 20$^1$.

Figure 2:
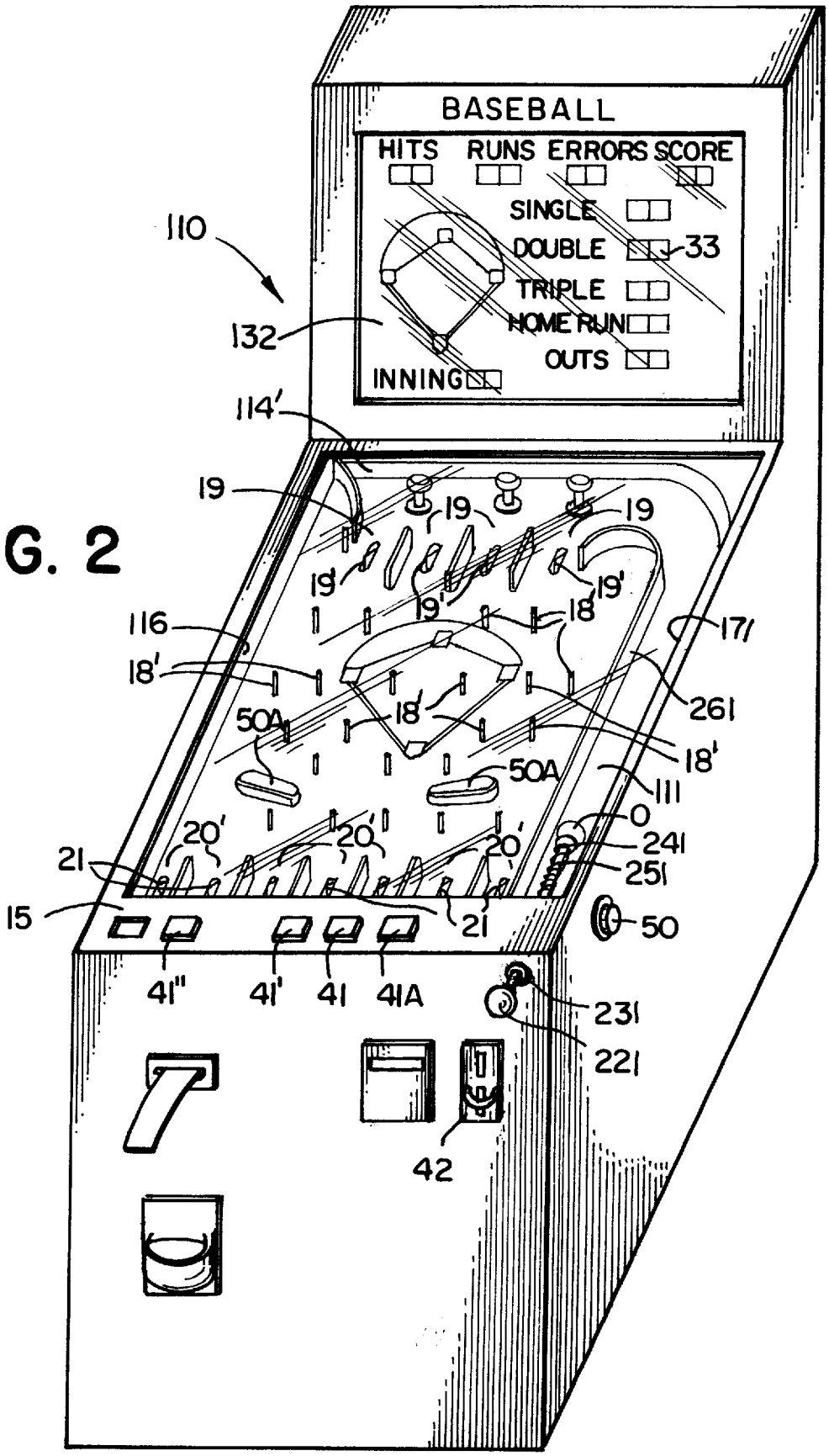
FIG. 2 is a perspective view of a baseball game apparatus according to the invention.

FIG. 2 represents a game similar to that shown in FIG. 1. The game differs by not providing sensors along the bases and allowing the play of multiple innings.

The apparatus 110 has a top wall 114$^1$, side walls 116 and 171. A launch channel 111 is formed by wall 261 and 171. A ball 0 is put into play by extending a knob 221 which is attached to rod 23 which extends into the channel 111. The ball 0 is put into play when the knob 221 is released and the compression spring 251 has the front end 241 impact on the ball 0 where upon it will enter the playing field. On the playing field the ball 0 will encounter the bumpers and/or pins 18$^1$ as well as the slots 19 and 20.

A difference from the game of FIG. 1 is that multiple coins can be placed in coin slot 42 to pay for extra innings or for two players to oppose each other. In which case, the buttons 41, 41A, 41$^1$ and 41$^{11}$ are associated to signal a microprocessor the activities played. Button 41 represents one player and button 41A represents the second play which informs the microprocessor which program is to be used. Button 41$^1$ releases a ball onto the launch channel 111 for play. Button 41$^{11}$ starts the game after the coins are placed in coin slot 42.

Similar to the game shown in FIG. 1, there are flippers 50A activated by a button 50 which keep the ball 0 in play to keep it from entering an out slot which may be represented by one or more slots 20.

Figure 3:
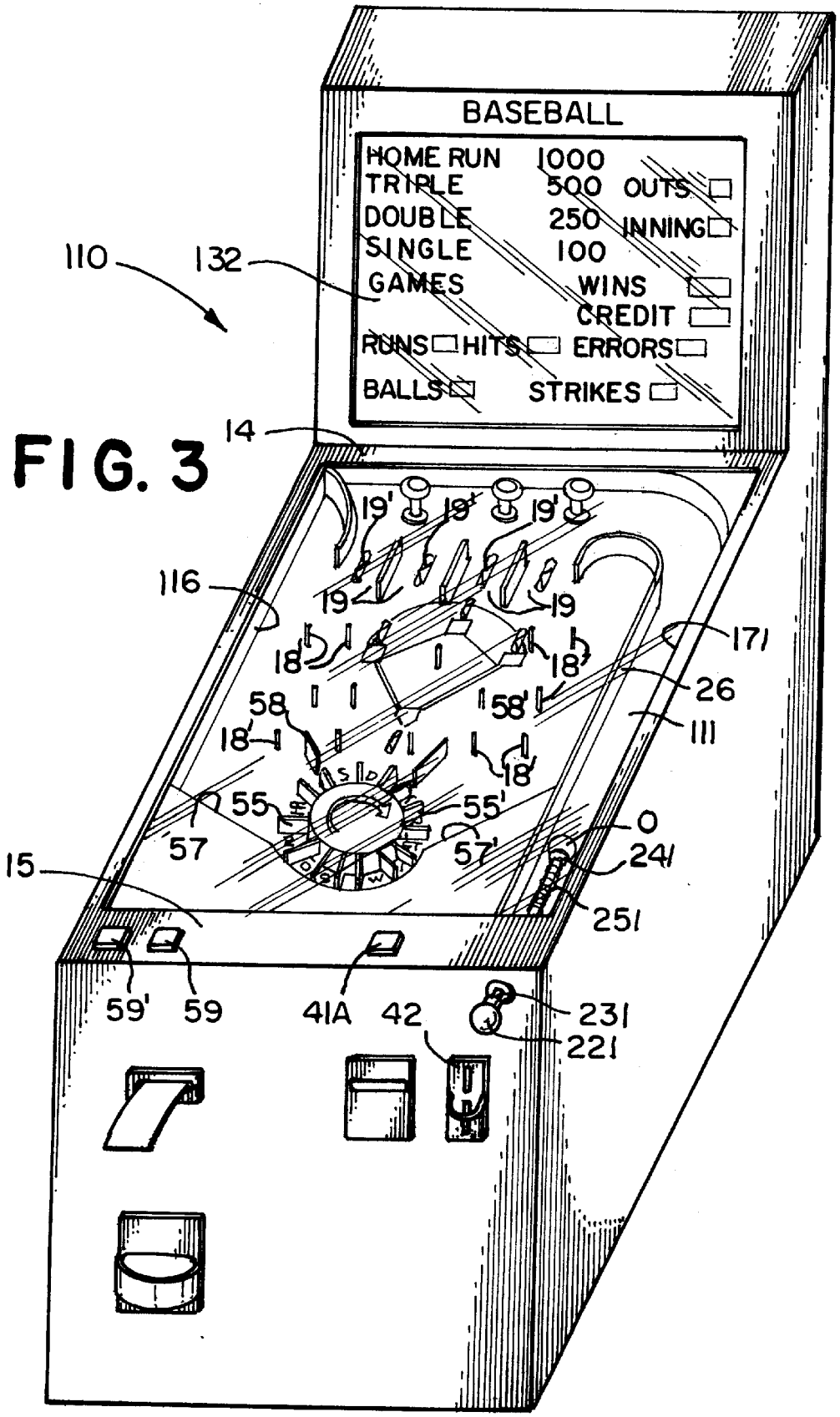
FIG. 3 is a perspective view of further embodiment of the invention.

FIG. 3 shows another embodiment of the invention wherein the bottom slots are on a carousel 55. The carousel is controlled by a microprocessor which randomly selects which slots 55[1] are accessible by a played ball 0. Each of the slots 55[1] has a sensor (not shown) which senses a ball 0 entering and falling into ball return 56. Walls 57, 57[1] and 58 deflect the ball 0 into one of the slots 55.

The game can contain the options programmed into the microprocessor whereby the plays, pitches or the like, are drawn by the microprocessor or obtained by playing the game a plurality of balls until one or three outs are reached. The game may be drawn to a single player at bat or a part of an inning.

The machine can alternately be provided with a single forward slot, which in combination with a video display advances a runner on base that is determined by the microprocessor, or the carousel can comprise a multiplicity of slots, which are for determining a hit, steal, out, etc. Buttons 59 and 59[1] provide the player with the option to select how the game is to be played.

Figure 4:
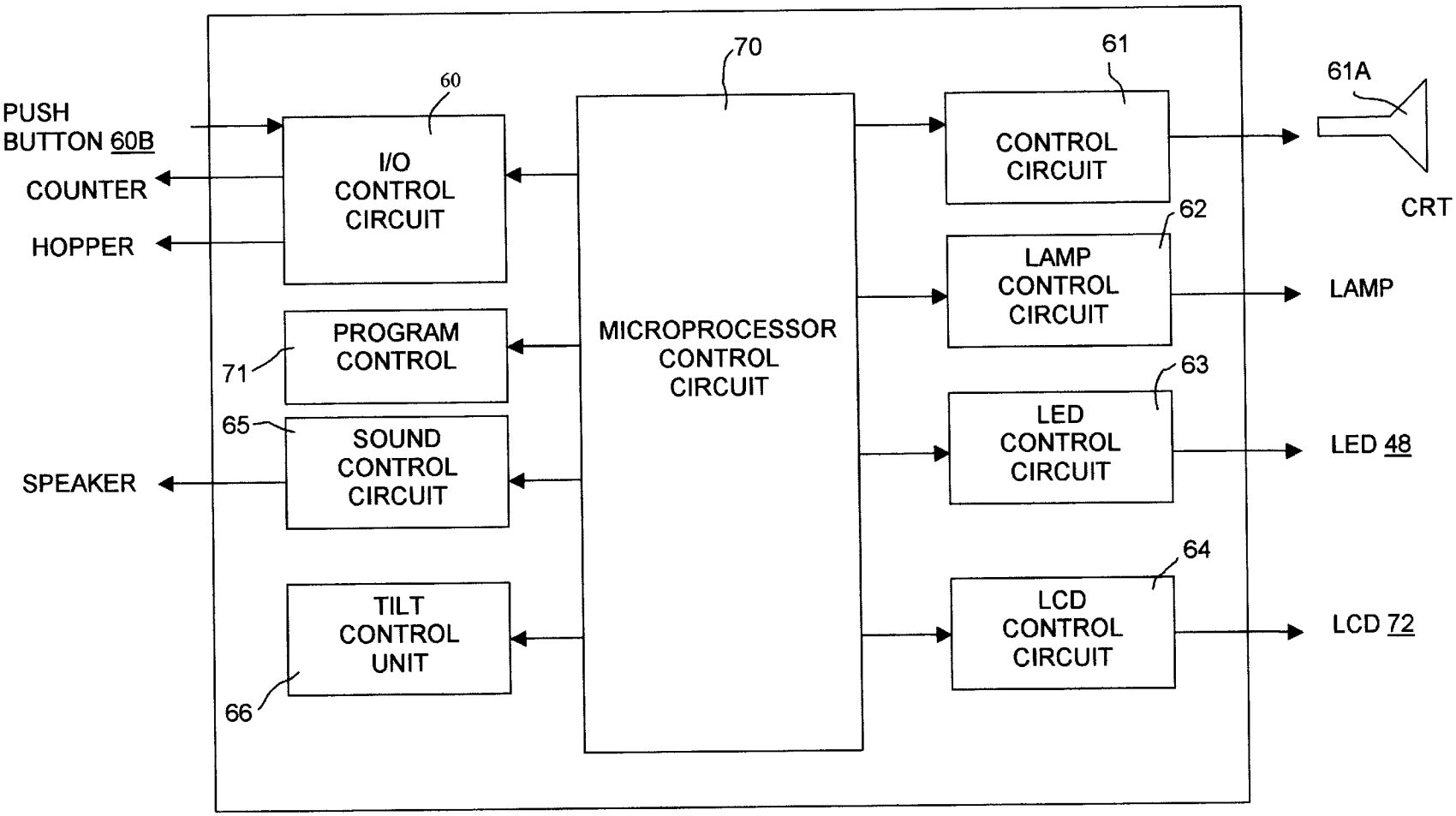
FIG. 4 is a block diagram showing a configuration of a football game pinball machine according to the present invention.

FIG. 4 is a block diagram showing a configuration according to the present invention wherein a microprocessor or CPU 70 is a memory device in which every processing program is stored. CPU 70 controls the LCD display 64, a coin insertion and detection unit 60 for detecting the insertion of a coin and includes a coin payout unit for paying out coins.

The CPU has a motor control unit 61 which controls the activation of the sensors 21, 22, a lamp control unit 62 which illuminates the apparatus upon insertion of a coin, a LED control unit 63 for the LED's 48 of the sensors 21, 22 and other illuminations, a LCD control unit 64 for the video display which also contains a graphic RAM for storing graphic data to be sent to the video display and a character ROM in which character data are stored, and a sound control unit 65 which stores sounds or announcements for different activities on the video display.

The device of the invention contains a memory device 71 in which every processing program is stored, means for controlling operations of the processing programs, a CRT control circuit 61 with a CRT display for images of base runners, a coin insertion detector 60B for detecting the insertion of coins, a counter of coins and a payout hopper.

The CRT control circuit 61 comprises a CRT controller for controlling the images to CRT 61A, a graphic RAM for storing graphic data to be sent to the CRT 61A and a character ROM in which character data are stored.

A baseball game can be played by allowing play of a multiplicity of balls until three outs are reached. The slots at the front of the apparatus can represent hits, outs, balls or strikes.

The slots at the rear of the apparatus can represent one or more outs, double play, hit, home run and the like. A ball going through slot 19 can represent a single. The striking of selective bumpers can represent a steal. The entry of a ball into slot 20 can represent hit, out, double play, etc. All of which plays are programmed into the microprocessor.

Advantageously, a video program with sound displays the action of the balls. The same action occurs in a softball game.

Figure 5:
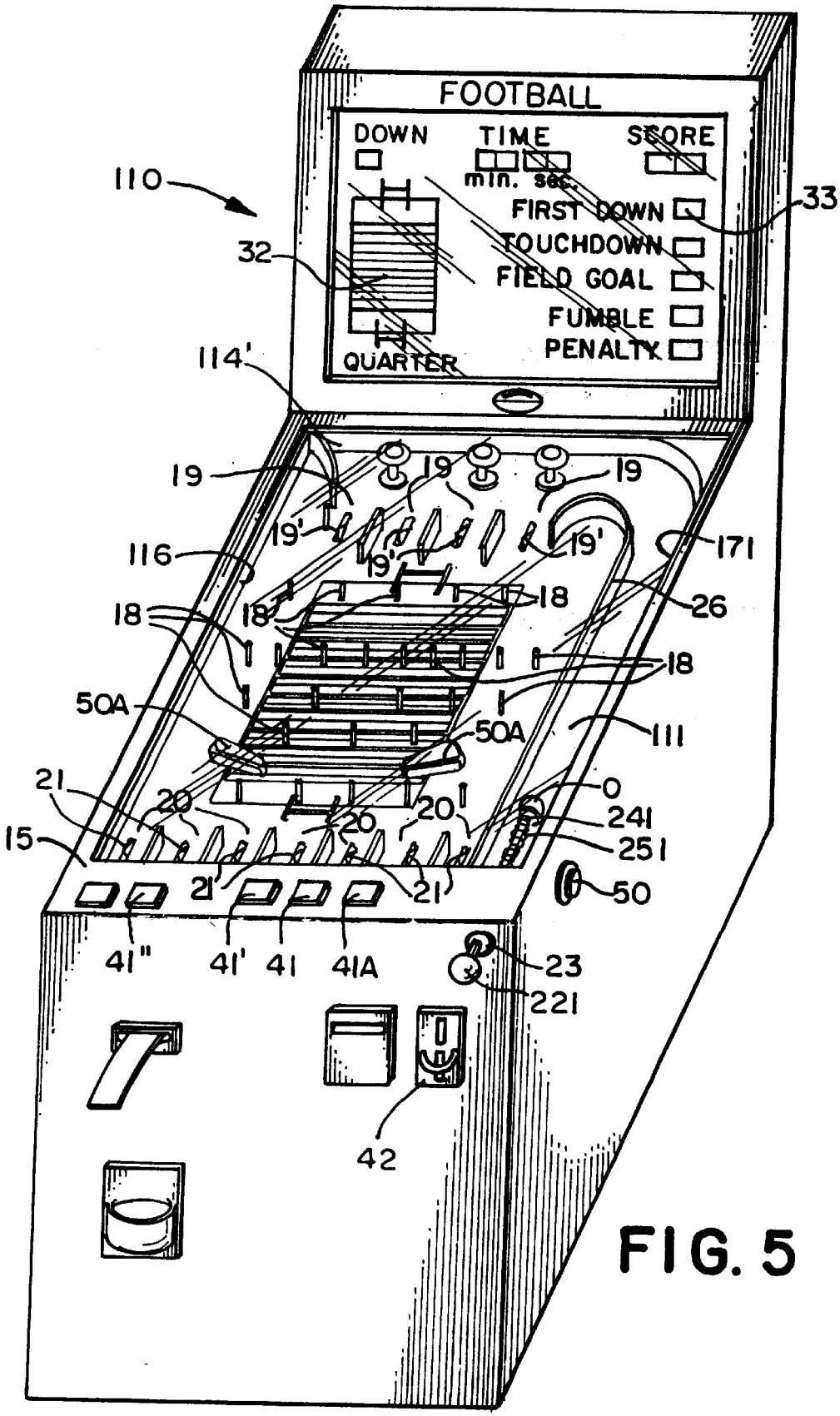
FIG. 5 is a perspective view of a football game similar to the apparatus of FIG. 2.

FIG. 5 represents a football game using an apparatus similar to FIG. 2 except that a football field is shown and the scoring is in accordance with activities on a football field.

In a football game, the object is to score a touchdown, which can be represented by a ball reaching the rear slots. The front slots can represent first downs, loss yardage, etc. Selected bumpers can provide first downs or lost yardage, all of which is shown by the microprocessor on a video screen. The rear slots can represent touchdown, field goal, fumble, etc. When a programmed score or a fumble or the other side takes possession the game is over. A payout occurs when there is a score.

Games, which can be programmed for the apparatus include baseball, softball, football, rugby and soccer.

Sounds which can be programmed into the microprocessor can be that of a sports announcer which announces "hit, out, etc" in a baseball game or the like.

The player may choose to continue to play based on the cumulative score or he may choose to pay out. The machine may be programmed to dispense tickets or coins.

While the invention is susceptible to various modifications and alternative forms, specific embodiments thereof have been shown by way of example in the drawings and will herein be described in detail. It should be understood, however, that it is not intended to be limited to the particular embodiments shown, but on the contrary, the intention is to cover all modifications, equivalents and alternatives falling within the spirit and scope of the appended claims.

What is claimed is:

1. A sports game pinball machine for playing a sports game, said machine having a housing with a top wall, a rear wall and a pair of side walls and of which the upper face is designed as a playing area, said housing having means for translating at least one ball throughout a plurality of locations therein, means for launching said ball for play action and means for displaying a sports action responsive to said play action, said play area being inclined downwardly so that a ball will roll downwardly because of gravity and having a multiplicity of slots about the rear wall having means for sensing said ball for determining an activity, which is part of the game that is represented by said slot, and a programmed microprocessor, which depicts a sports activity by the action of a ball on the playing field.

2. The machine of claim 1 including a multiplicity of slots about the front wall having means for sensing said ball for determining a game play.

3. The machine of claim 2 wherein slots about the front wall comprise at least four.

4. The machine of claim 1 wherein said means for scoring and controlling the process of said game comprises a microprocessor programmed for the sport of baseball or football.

5. The machine of claim 1 wherein the slots about the rear wall are on a rotary carousel.

6. The machine of claim 5 wherein said carousel is rotated and controlled by said microprocessor.

7. The machine of claim 1 wherein said machine comprises value determining depicting means and balls are played, said determining means relates to an inning played by a team in the game of baseball.

8. The machine of claim 1 wherein said machine comprises baseball determining means for balls played for the game of baseball.

9. The machine of claim 1 wherein said first slots are selectively activated to represent yardage in a football game.

10. The machine of claim 1 including a tilt detector.

11. The machine of claim 1 including flipper means.

12. The machine of claim 1 including means for providing a visual display and sound when a ball enters a selected slot to activate a video of a game activity.

13. The machine of claim 1 including a movement determining means for determining the position of a player on a base in the game of baseball.

* * * * *